United States Patent [19]

Groom et al.

[11] 4,178,740

[45] Dec. 18, 1979

[54] WRAPPING MACHINE

[75] Inventors: James S. Groom, Wales; Clarence F. Prince, Springfield, both of Mass.

[73] Assignee: Package Machinery Company, East Longmeadow, Mass.

[21] Appl. No.: 871,623

[22] Filed: Jan. 23, 1978

[51] Int. Cl.[2] ..... B65B 11/18

[52] U.S. Cl. ..... 53/556; 53/226; 53/228

[58] Field of Search ..... 53/222, 226, 228, 229, 53/230, 231, 232, 233, 441, 556

[56] References Cited

U.S. PATENT DOCUMENTS

| | | | |
|---|---|---|---|
| 1,902,734 | 3/1933 | Stpeng | 53/223 |
| 2,808,693 | 10/1957 | Guggenheim | 53/387 X |
| 3,236,024 | 2/1966 | Bradley et al. | 53/229 X |
| 3,237,372 | 3/1966 | Hartman | 53/228 |
| 3,242,635 | 3/1966 | Kobick | 53/222 |
| 3,327,453 | 6/1967 | Willbrandt | 53/228 |
| 3,662,513 | 5/1972 | Fabbri | 53/226 X |
| 3,967,433 | 7/1976 | Bonfiglioli | 53/228 X |
| 3,977,158 | 8/1976 | Jennings | 53/226 |
| 4,035,985 | 7/1977 | Aoyama et al. | 53/222 |
| 4,078,363 | 3/1978 | Panzi | 53/228 |

*Primary Examiner*—John Sipos

*Attorney, Agent, or Firm*—McCormick, Paulding & Huber

[57] ABSTRACT

A machine for stretch wrapping articles, such as trays of produce, poultry, meat and the like, has a wrapper feeding mechanism which positions measured lengths of stretchable wrapping material between an elevator mechanism and a folding mechanism which is located above the elevator mechanism and includes a plurality of relatively movable folding plates. Clamping mechanism releasably secures opposite marginal portions of the positioned wrapping material while the elevator mechanism raises an article to be wrapped into stretching engagement with the wrapping material, held by the clamping mechanism, and pushes the article up through an opening of adjustable size defined by parts of the wrapper feeding mechanism and the folding mechanism to stretch the wrapping material tightly over the article. Portions of the taut wrapping material are then folded under the article by the folding mechanism. A remaining portion of the wrapping material is folded under the article as the article is moved by an overhead conveyor across a stationary folding plate to a heat sealing station where the folded under portions of the wrapper are sealed against the bottom of the wrapped package.

12 Claims, 17 Drawing Figures

WRAPPING MACHINE

BACKGROUND OF THE INVENTION

This invention relates in general to wrapping machines and deals more particularly with an improved stretch wrapping machine for packaging articles, such as trays of produce, poultry, meat and the like in stretchable wrapping material such as plastic film. Wrapping machines of the aforedescribed general type have been heretofore available and typical wrapping machines of the type with which the present invention is concerned are illustrated and described in U.S. Pat. Nos. 3,662,513 to Fabbri, issued May 16, 1972 and 3,977,158 to Jennings et al, issued Aug. 31, 1976. Such stretch wrapping machines generally utilize a matrix plate which has an opening of fixed size generally corresponding to the article to be wrapped. During the stretching phase of the wrapping cycle, an article to be wrapped is pushed upwardly against a stretchable wrapper and through the opening in the matrix plate while opposing edges of the wrapper are held fast, so that the wrapper is stretched over the article and pulled inwardly against its sides. Such an arrangement is quite satisfactory for use in a machine for long run production when articles to be wrapped do not vary significantly in size and shape. However, when such a machine is used in short run production to wrap articles which vary significantly in character it is necessary to remove the matrix plate at the end of each production run and replace it with another matrix plate corresponding to the next article to be wrapped. Such machine setup operations require a skilled mechanic and result in substantial machine downtime. The present invention is concerned with the aforedescribed problem.

It is the general aim of the present invention to provide an improved stretch wrapping machine which may be rapidly and accurately adjusted by a person of ordinary skill, such as a machine operator, and which may be adjusted to wrap articles in a wide range of sizes without removing or replacing machine parts.

SUMMARY OF THE INVENTION

In accordance with the present invention, an improved wrapping machine includes a folding mechanism which has a plurality of relatively movable folding members, a wrapper feeding mechanism for positioning a stretchable wrapper in juxtaposition to the folding mechanism, holding means for releasably securing in fixed position at least two opposing portions of a wrapper positioned by the feeding means, article moving means for receiving an article to be wrapped in one position and for moving it toward the folding members and into stretching engagement with the wrapping material secured by the holding means and to another position beyond the folding members, and means for defining an opening of adjustable size through which the article is constrained to pass when it is moved by the article moving means from its one to its other position, the opening defining means comprising parts of said feeding mechanism and said folding mechanism.

DESCRIPTION OF THE PREFERRED EMBODIMENT

Figure 1:
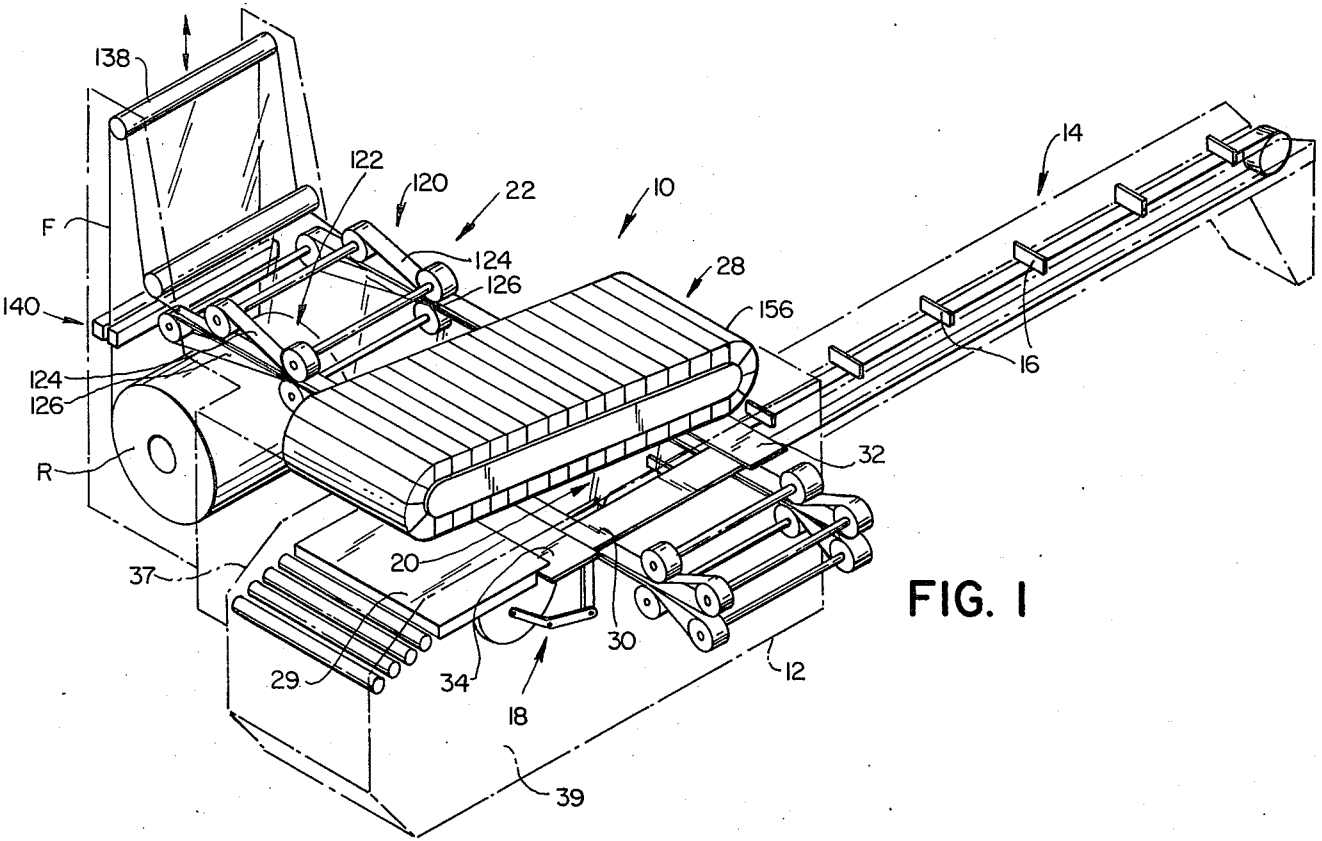
FIG. 1 is a perspective view of a wrapping machine embodying the present invention, the machine frame being shown in phantom.
Figure 2:
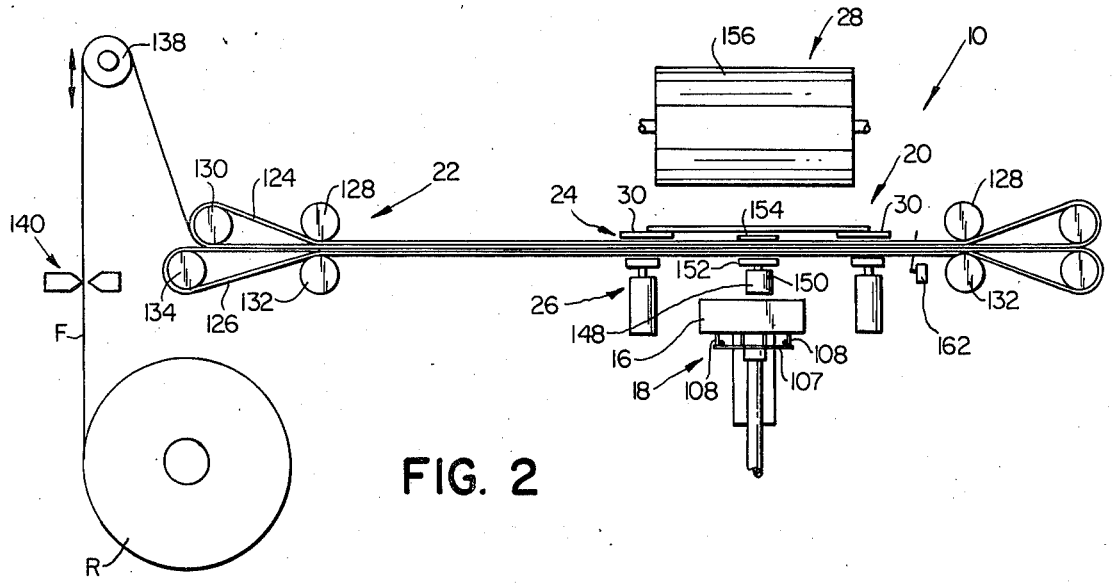
FIG. 2 is a somewhat enlarged fragmentary schematic end elevational view of the wrapping machine of FIG. 1.
Figure 3:
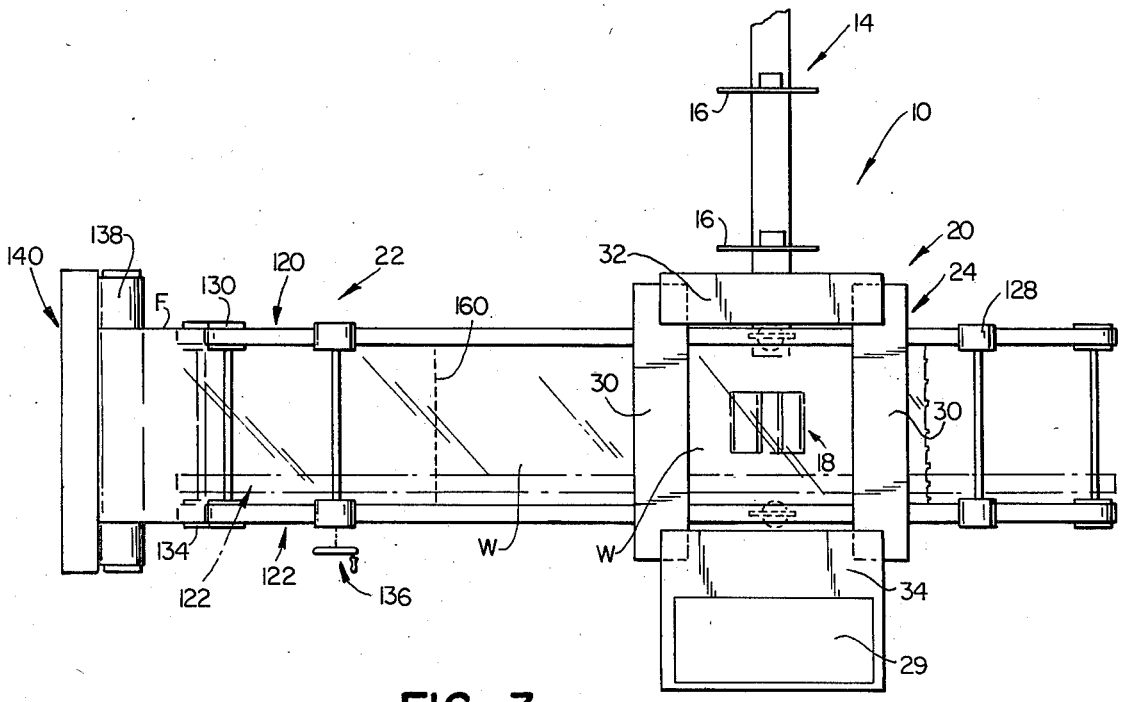
FIG. 3 is a somewhat enlarged fragmentary schematic plan view of the machine of FIG. 1.

Turning now to the drawings and referring first particularly to FIGS. 1–3, a wrapping machine embodying the present invention and indicated generally by the reference numeral 10 is particularly adapted to wrap articles, as for example, trays of produce, poultry, meat and the like, in stretchable wrapping material, such as plastic stretch film, indicated by the letter F. The illustrated machine 10 is capable of wrapping articles which vary widely in character, shape and size and has a frame 12, shown in phantom in FIG. 1, and an article infeed conveyor of conventional type, located at the front end of the machine and indicated generally at 14. The infeed conveyor has a plurality of flight bars 16, 16, operates in timed relation with an elevating mechanism, indicated generally at 18, and conveys articles to be wrapped to the elevating mechanism which is located at a wrapping station, designated generally by the numeral 20, and best shown in FIGS. 2 and 3. A wrapper feeding mechanism, indicated generally at 22, feeds measured lengths of stretchable wrapping material F or wrappers W, W into the machine 10 in a transverse direction relative to the infeed conveyor and at an elevation higher than the elevation of the infeed conveyor 14. The wrapper feeding mechanism 22 positions each successive wrapper W below a folding mechanism 24, which is also located at the wrapping station 20. At least two opposing portions of a stretchable wrapper W positioned by the wrapper feed mechanism 22 are releasably secured in fixed position at the wrapping station 20 by a holding mechanism, indicated generally at 26, while the elevating mechanism 18 raises an article A to be wrapped into stretching engagement with the wrapper W and pushes it up through an opening, defined by parts of said wrapper feeding mechanism 22 and the folding mechanism 24, to stretch the wrapper W tightly over the article A. Portions of the taut wrapper are then folded under the article A by the folding mechanism 24. The package is completed when an overhead conveyor, indicated generally at 28, which operates intermittently, moves the wrapped article from the wrapping station 20 to a heat sealing unit 29, located at the rear or discharge end of the machine, where the folded end portions of the wrapper W are sealed against the bottom of the wrapper to complete the package, all of which will be hereinafter further described.

Considering the machine 10 in detail, and referring particularly to FIGS. 3–6, the frame 12 is generally formed by spaced apart side members 37 and 39 connected together by a plurality of horizontal tie rods which extend therebetween. The wrapper folding mechanism 26 comprises a plurality of relatively movable folding members supported on the frame 12 and which include a pair of transversely opposed side folding members or folding plates 30, 30 and a pair of longitudinally opposed end folding members or folding plates 32 and 34. The side folding plates 30, 30 are supported for horizontal sliding movement generally toward and away from each other between first and second positions, respectively shown in FIGS. 3 and 15, by a pair of parallel rods 36, 36, best shown in FIGS. 4 and 5, which are mounted on and extend transversely between the frame side members 37 and 39. The folding plates 30, 30 are further arranged for adjustment relative to each other so that the spacing between the opposing inner edges of the plates, in first position, may be varied.

Figure 5:
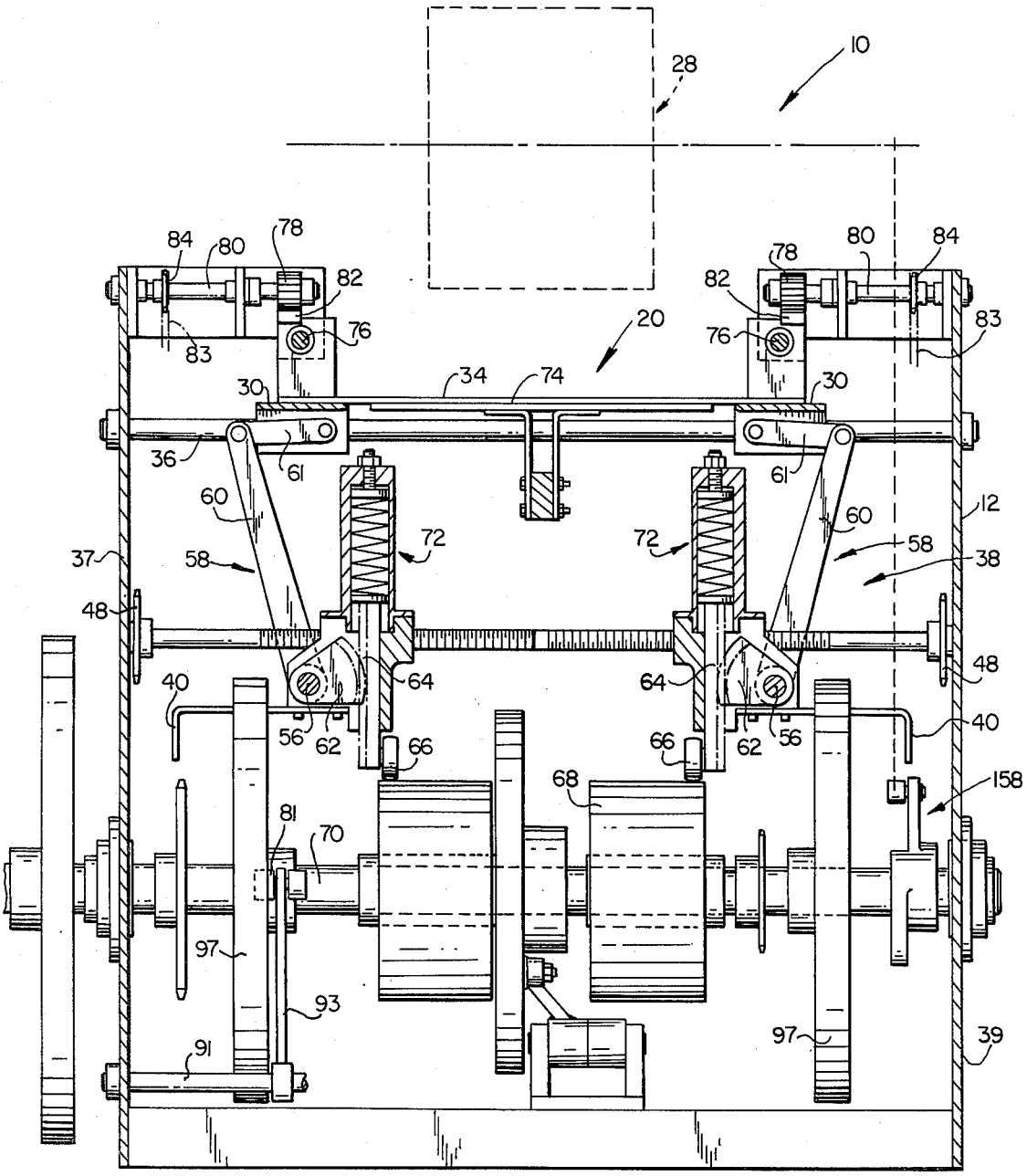
FIG. 5 is a fragmentary sectional view taken generally along the lines 5—5 of FIG. 4.
Figure 6:
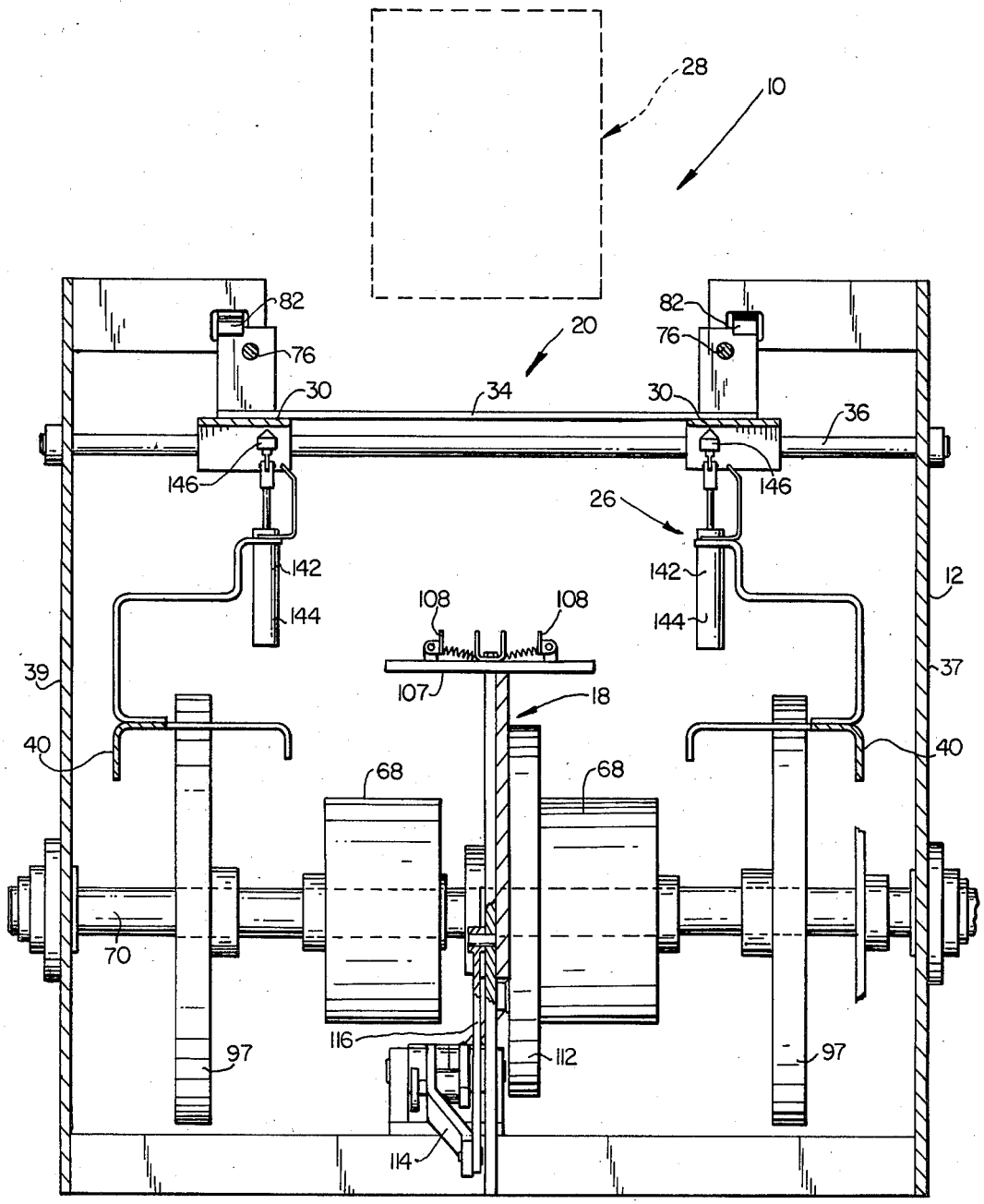
FIG. 6 is a fragmentary sectional view taken generally along the lines 6—6 of FIG. 4.
Figure 7:
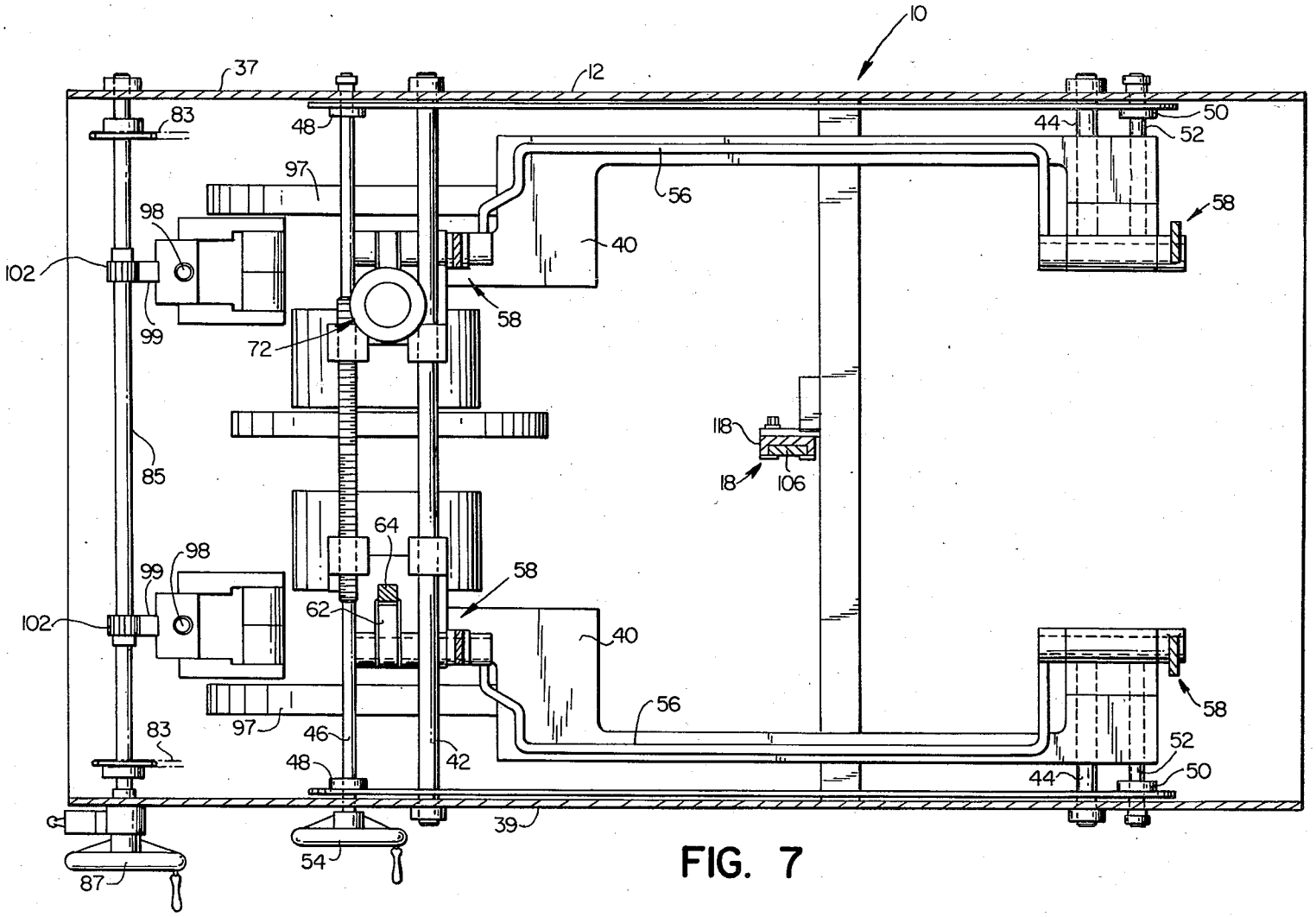
FIG. 7 is a sectional view taken generally along the line 7—7 of FIG. 4.
Figure 8:
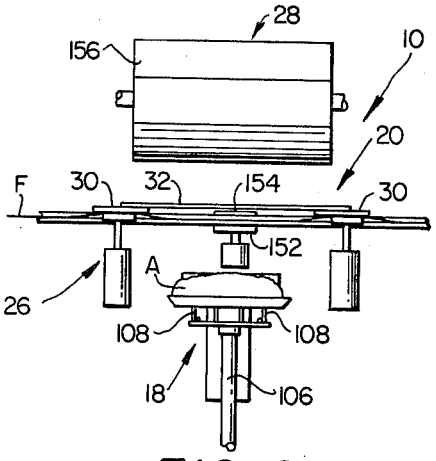
FIGS. 8 to 12 are diagrammatic end elevational views and illustrate successive stages of the wrapping cycle.
Figure 13:
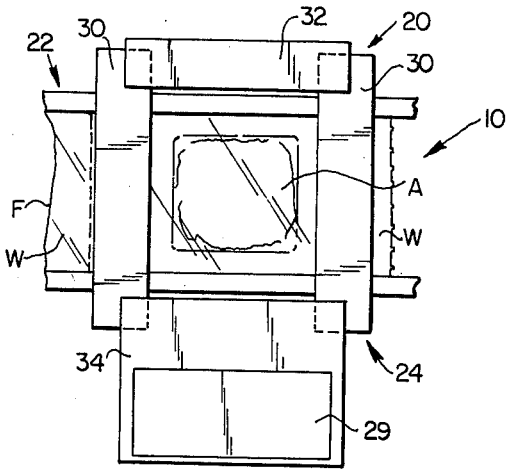
FIGS. 13–17 are fragmentary diagrammatic plan view of the wrapping station and heat sealing unit and shows successive stages of the wrapping cycle respectively corresponding to the wrapping stages shown in FIGS. 8–12.
Figure 9:
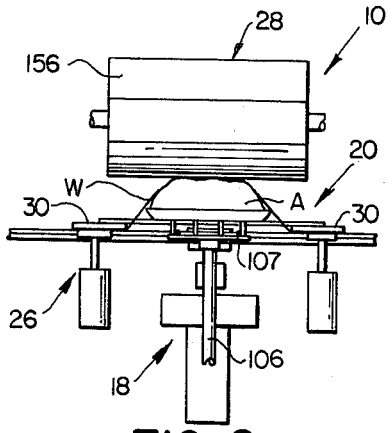
Figure 14:
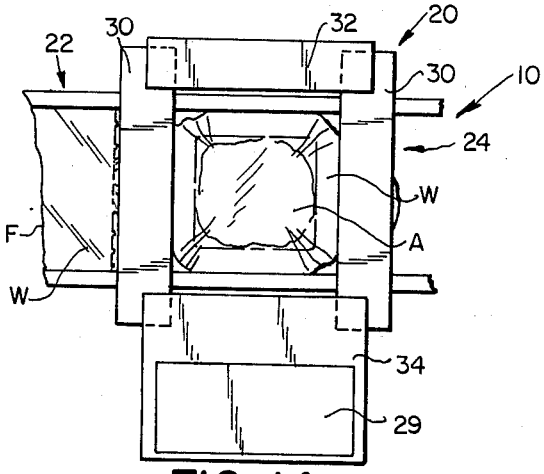
Figure 10:
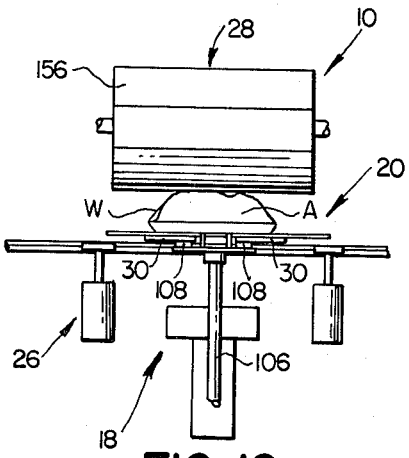

Referring now particularly to FIGS. 4–7, the mechanism for adjusting the positions of the plates 30, 30 and for imparting folding movement to the latter plates is indicated generally at 38 and includes a pair of transversely spaced apart and longitudinally extending support members 40, 40 carried by the frame 12 and located generally below the folding plates 30, 30 and best shown in FIG. 7. Each support member 40 is supported at its rear end for transverse sliding movement on a horizontal support rod 42 which is carried by and extends between frame side members 37 and 39. Each support assembly 40 is supported at its rear end to slide on a relatively short support rod 44 which is mounted on and extends inwardly from an associated one of the frame side members 37 and 39. At its front end, each support member 40 is threadably engaged with a horizontal adjustment rod 46 which is journalled on and extends between the frame side members 37 and 39. Sprockets 48, 48 mounted near the ends of the adjustment rod 46 and inboard of the frame side members are connected by drive chains to another pair of sprockets 50, 50 respectively mounted on a pair of short adjustment rods 52, 52. The adjustment rods 52, 52 are respectively journalled at opposite sides of the frame 12 and project inwardly therefrom to threadably engage the rear ends of the respectively associated support assemblies 40, 40. The adjustment rods 46 and 52, 52 have right and left hand threads which respectively engage the support assemblies 40, 40 to move them in parallel relation and generally toward and away from each other in response to rotation of a hand wheel 54 mounted on one end of the adjustment rod 46 and outboard of the machine frame.

Each support assembly 40 carries an elongated rock shaft 56 which is journalled near its opposite ends at opposite end of the support assembly as best shown in FIG. 7. Each rock shaft 56 is connected to an associated one of the side folding plates 30 by a pair of linkages indicated generally at 58, 58 and mounted, respectively, at the front and rear ends of the rock shaft. Referring now particularly to the mechanism for moving the folding plate 30 located at the right hand side of the machine 10, as it appears oriented in FIG. 5, each linkage 58 includes a pair of links 60 and 61. One linkage 58 is connected between the front end of the rock shaft 56 and the front end of the folding plate 30. The other linkage 58 provides connection between the rear end of the folding plate 30 and the rear end of the rock shaft 56. A gear segment 62 mounted in fixed position on the front end of the rock shaft 56 meshes with a rack 64 supported for vertical sliding movement on the support assembly 40. A roller follower 66 journalled at the lower end of the rack 64 engages a barrel cam 68 mounted on a main drive shaft 70 which is journalled on and extends transversely between the frame side members 37 and 39. An adjustable compression spring mechanism indicated generally at 72 acts between the rack 64 and the support assembly 40 to continuously urge the roller follower 66 toward engagement with the barrel cam 68.

Figure 4:
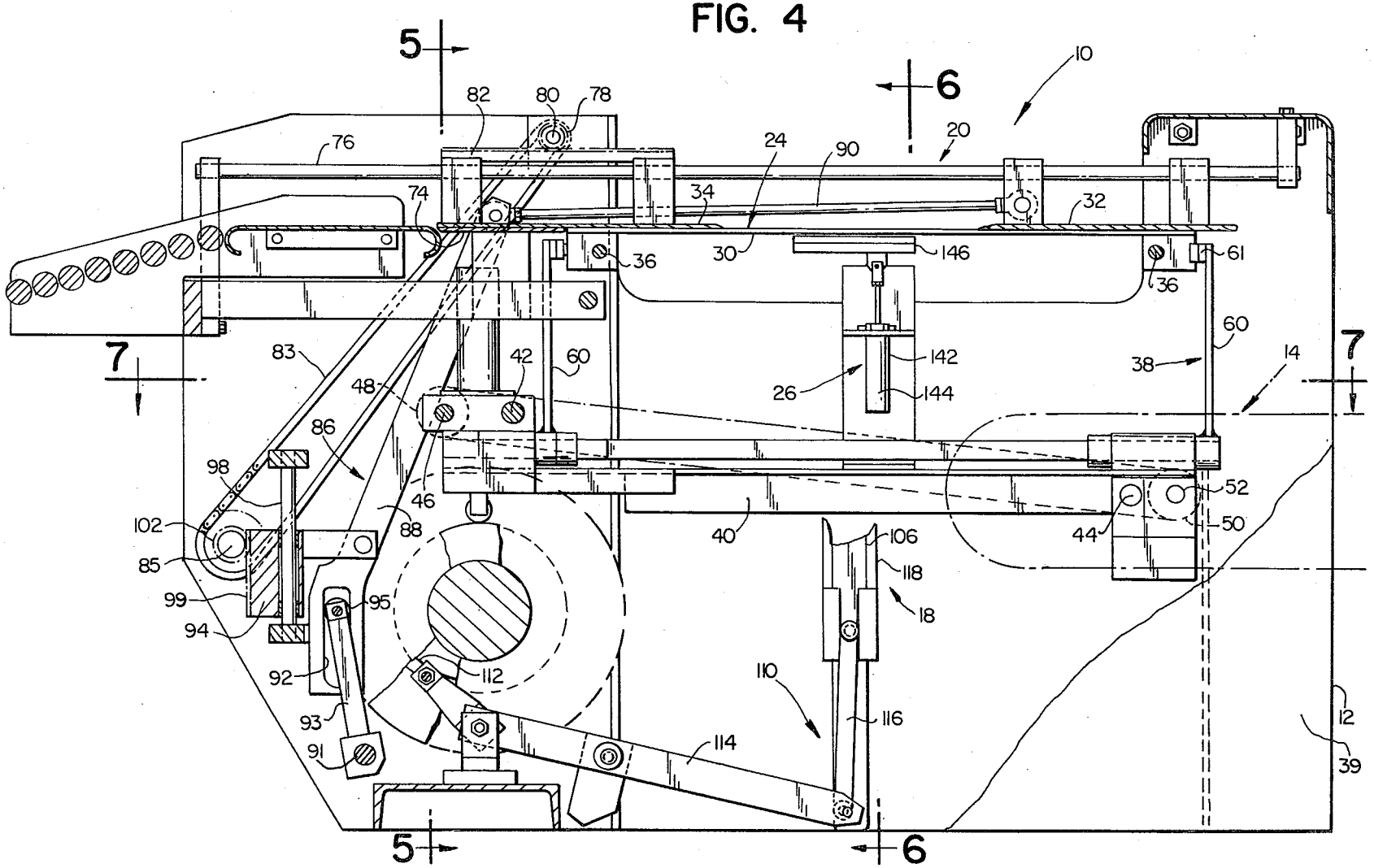
FIG. 4 is a somewhat further enlarged fragmentary side elevational view similar to FIG. 3, but shows parts of the wrapping mechanism in general longitudinal section and in further detail.

Further considering the folding mechanism 24, the end folding plate 34 is supported stationary position relative to the machine frame 12, but is mounted so that it may be adjustably positioned relative to the opposite end folding plate 32 when the folding plates are in first position, as shown in FIG. 3. Referring now particularly to FIGS. 4 and 5, the end folding plate 34 is supported above and immediately adjacent a stationary bed plate 74 mounted in fixed position on the machine frame 12. The folding plate 34 is supported to slide on a pair of parallel longitudinally extending guide rods 76, 76 which are mounted at opposite sides of the machine frame 12. Pinions 78, 78, mounted on stub shafts 80, 80 journalled at opposite sides of the frame 12 respectively engage racks 82, 82 mounted in fixed position at transversely opposite ends of the plate 34, as best shown in FIG. 4. Sprockets 84, 84 mounted on the outer ends of the stub shafts 80, 80 are connected respectively, by drive chains 83, 83 to a common horizontal adjustment shaft 85, shown in FIGS. 4 and 7 which extends transversely of the machine frame. The aforedescribed rack and pinion mechanism provides means for moving the plate 34 generally toward and away from the plate 32 to vary the spacing between the plates 32 and 34 in first position in response to rotation of a hand wheel 87 mounted on one end of the adjustment shaft 85.

Figure 16:
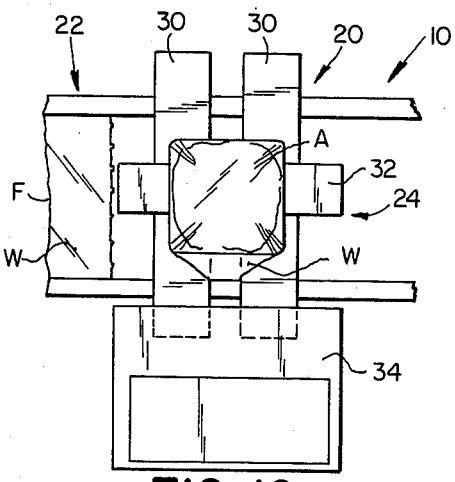
Figure 12:
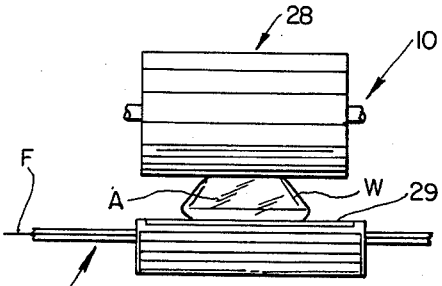
Figure 17:
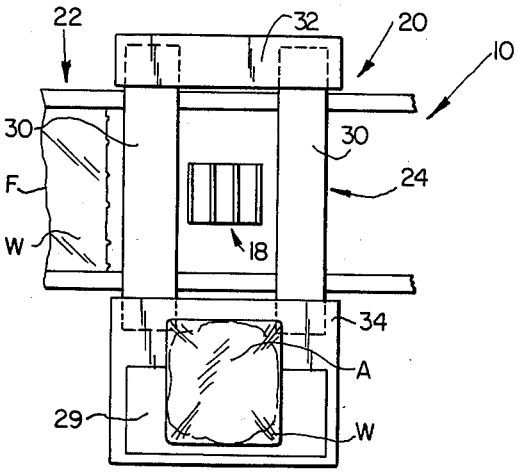

The end folding plate 32 is supported for sliding movement on the guide rods 76, 76 between its first position, as it appears in FIG. 3, and toward the end folding plate 34 and to its second position, shown in FIG. 16. The mechanism for moving the folding plate 32, indicated generally at 86 and best shown in FIG. 4, includes a pair of transversely spaced adjustable links 88, 88 (one shown) located at opposite sides of the machine 10. Each link 88 is connected at its upper end to an associated end of the plate 32 by a connecting link 90. Each link 88 has a slot 92 formed in its lower end and is pivotally supported intermediate its ends on a vertically adjustable pivot block 94. A pair of drive links 93, 93 (one shown in FIG. 4), supported on a horizontal rock shaft 91 which extends transversely of the machine frame near its base, drive the links 88, 88. Each link 93 has a drive roller 81 at its upper end engaged within an associated track cam 97 mounted on the main shaft 70. Each pivot block 94 is supported to slide on a vertical rod 98 mounted in fixed position on the machine frame 12 and carries a rack 99. The adjusting shaft 85 has pinions 102, 102 mounted thereon which respectively engage the racks 99, 99. It will now be apparent that the adjusting shaft 85 facilitates adjustment of the throw of the links 88, 88 in response to rotation of the track cams 97, 97 to vary the travel of the end folding plate 32 between its first and second positions and simultaneous adjustment of the first position of the stationary plate 34 relative to the folding plate 32.

The elevating mechanism 18 is located in an elevator well below the folding mechanism 24 and includes an article elevator 106 which has a base plate 107 and a plurality of elongated blade-like article support members 108, 108, best shown in FIG. 6 and connected to the base plate to pivot about parallel axes which extend longitudinally of the machine 10. The article support members 108, 108 are normally spring biased to upwardly projecting article supporting positions wherein the upper edges of the support members are disposed in generally horizontal plane and define an article supporting surface for receiving and supporting an article, such as a tray of meat or the like. The article elevator 106 is supported for vertical reciprocal movement between raised and lowered positions by a cam operated link mechanism indicated generally at 110 in FIG. 4 and operated by a track cam 112. More specifically, the link mechanism 110 includes a break away link assembly 114, driven by the track cam 112, and a connecting link 116 connected to the end of the link 114 and to the article elevator 106, which is, in turn, supported for vertical movement by a vertical guide track 118. The break away link 114 is formed in two parts coupled together in driving relation by a spring projected detent mechanism (not shown) which releases to allow the elevator to drop to its lower position in the event that it encounters an obstruction while it is being elevated by the link mechanism 110.

The elevator mechanism 18 is driven in timed relation with the folding mechanism 24 and moves the article elevator 106 upwardly through an opening formed by the folding plates when the latter plates are in first position. When the elevator is in its lowered position the article supporting surface defined by the article support members 108, 108 is generally horizontally aligned with the infeed conveyor 14 to receive an article to be wrapped from the infeed conveyor.

As illustrated, the wrapper feeding mechanism 22 is arranged at a right angle to the infeed conveyor 14 and includes two sets of belts respectively generally indicated at 120 and 122. Each set of belts includes an upper belt 124 and a lower belt 126. The upper belts are supported by idler rolls 128, 128 and driving rolls 130, 130 as best shown in FIG. 2. In like manner, the lower belts 126, 126 are supported by idler rolls 132, 132 and drive rolls 134, 134. Each upper belt 124 is supported to run in adjacent relation to an associated lower belt 126 so that the conveying runs of belts are closely adjacent to each other to receive the film F therebetween. The belt sets 120 and 122 are horizontally spaced apart so as to engage only the longitudinally extending edge portions of the film F so that the central portion of the film is exposed between the belts, at least in the area of the wrapping station 20. Another belt set, of somewhat shorter length than the belt sets 120 and 122, is preferably provided intermittent the latter belt sets and parallel thereto for support a central portion of the wrapping material as it is advanced toward the wrapping station 20. However, for clarity of illustration this other belt set is not shown.

The belt set 120 is supported in fixed position relative to the machine frame 12. An adjusting screw mechanism shown somewhat schematically in FIG. 3 and indicated generally by the reference numeral 136 is provided for adjusting the position of the belt 122 relative to the belt set 120. More specifically, the adjusting mechanism, indicated generally at 136 in FIG. 3, facilitates adjustable movement of the belt set 122 generally toward and away from the belt set 120 while maintaining the belt set in parallel relation so that the spacing between the belts sets 120 and 122 may be varied, as may be required to accommodate wrapping materials of varying widths. Wrapping film is delivered to the machine in a continuous web from a supply roll indicated at R in FIGS. 1 and 2 and supported on and driven by the wrapper feeding mechanism 22. The wrapper feeding mechanism further includes a vertically adjustable idler roll 138 and a solenoid operated perforating mechanism 140 located between the supply roll R and the idler roll 138, and shown somewhat schematically in FIGS. 1 and 2. A solenoid operated clutch mechanism (not shown) provides drive connection between the machine drive and the wrapper feeding mechanism 22 whereby measured lengths of film may be intermittently fed to the wrapping station 20 in timed relation with the operation of other mechanism which comprises the machine 10. This intermittent feeding mechanism is adjustable so that the measured length of wrapping material delivered during each cycle of the machine 10 may be varied.

The holding mechanism includes at least one pair of holding devices for releasably securing opposing marginal portions of a wrapper advanced by the feeding mechanism 22. However, the illustrated holding mechanism 26 includes two pair of clamping devices which are operable to releasably secure four marginal portions of a generally rectangular wrapper at the wrapping station. More specifically, the holding mechanism 24 includes a first pair of clamping devices 142, 142, best shown in FIGS. 4 and 6 for respectively securing opposite marginal portions of a wrapper W against the lower surfaces of the folding plates 30, 30. Each clamping device 142 is carried by an associated support member 40 and is mounted below an associated one of the folding plates 30. Each clamping device 142 includes a fluid motor 144 which carries a clamping member 146. The fluid motors 144, 144 operate in timed relation with the other mechanism which comprises the machine 10 to move the clamping members 146, 146 into and out of clamping relation with the lower surfaces of the folding plates 30, 30. The illustrated holding mechanism 26 further includes another pair of clamping devices 148, 148, shown somewhat schematically in FIGS. 2 and 3, for clamping of associated marginal portions of a wrapper W at the wrapping station 20 and between the upper and lower belts 124 and 126 of each of the belt sets 120 and 122. Each clamping device 148 comprises a fluid motor 150 for moving a clamping member 152 generally toward and away from an opposing stationary clamping member or clamping plate 154. The upper and lower belts 124 and 126 of each set travel between a set of associated clamping members 152 and 154, substantially as shown in FIG. 2. The fluid motor 144, 144 and 150, 150 which operate in timed relation with the folding mechanism may be operated by timing cams or the like driven by or in timed relation with the main shaft 70.

The overhead conveyor 28 extends longitudinally of the machine between the wrapping station 20 and the heat sealing station 29, as best shown in FIG. 1. It comprises an endless belt 156 which carries soft resilient deformable platens made from sponge rubber or like material. It is supported on the frame 12 and is generally vertically adjustable toward and away from the wrapping station 20 to accommodate wrapped articles which may vary in size. The conveyor 28 is intermittently moved by a Geneva Mechanism, indicated generally at 158 in FIG. 5, driven by the main shaft 70. A chain and sprockets (not shown) drivingly connects to belt conveyor 156 to the Geneva Mechanism 158. The heat sealing unit 29 is located at the discharge end of the machine adjacent the bed plate 74 and is of a conventional type well known in the art.

Before considering the operation of the machine 10, various machine adjustments which may be required prior to operation will be generally discussed. The size of the wrapper W to be formed will, of course, be determined by the size of the article to be wrapped. The width of the wrapping material to be used is determined by the length of the package to be wrapped. The wrapper feeding mechanism 22 is adjusted to the width of the wrapping material by operating the adjusting mechanism 136 (FIG. 3) to move the belt set 122 toward or away from the belt set 120, as may be required, to conform to the width of the wrapping material. The spacing between the folding plates 32 and 34 is also determined by the length of the package to be wrapped as measured in the longitudinal direction when the package is positioned in the machine. The required movement of the folding plate 34 between its first and second position is also determined by the length of the package to be wrapped. However, as previously discussed, the latter two adjustments are made simultaneously by rotating the hand wheel 87 (FIG. 7) in one in or in an opposite direction, as may be required to move the plate 34 toward or away from the folding plate 32. The width of the package to be wrapped determines the required spacing between the side folding plates 30, 30. This adjustment is made by rotating the hand wheel 54 in either a clockwise or counterclockwise direction, as may be required to move the plates 30, 30 toward or away from each other whereby to vary the spacing therebetween.

It should be now noted that the opposing inner edges of the plates 30, 30 and the opposing inner edges of the belt sets 120 and 122, in the area of the folding station 20, form an adjustable matrix through which an article to be wrapped is constrained to pass when the article is raised by the elevating mechanism 18, as will be hereinafter further discussed.

The wrapper feeding mechanism 22 may be further adjusted to deliver a wrapper of measured length, the length of the wrapper being determined by the width of the article to be wrapped. The length of the wrapper to be delivered to the wrapping station 20 is varied by adjusting the intermittent feeding mechanism associated with the wrapper feeding mechanism 22 so that the wrapping material is advanced a distance equal to the required width of the wrapper during each cycle of the wrapper feeding mechanism. The perforating mechanism 140 operates once during each cycle of a wrapping feeding mechanism 22 to form a line of perforation 160 extending transversely of the web. Thus, the distance between successive lines of perforation 160, 160 formed on a continuous web of wrapping material advanced by the wrapping mechanism will correspond to the width of each wrapper W. The idler roll 138 is vertically adjustable to vary the length of path of travel between the perforating mechanism 140 and the wrapping station 20. The vertical position of the roll 138 is adjusted so that each successive cycle of the feeding mechanism advances the leading edge of the strip F to a predetermined position relative to the wrapping station. The overhead conveyor 28 may be vertically adjusted, as necessary, this adjustment being generally determined by the height of the package to be wrapped. The machine 10 is preferably provided with adjustable guides for directing articles into the machine and for guiding wrapped packages to be discharged therefrom, as is well known in the packaging art, however, for clarity of illustration these adjustable guides are not shown.

Considering now the operation of the machine 10 and referring particularly to FIGS. 2, 3, and 8–17. At the beginning of the operating cycle the elevating mechanism 18 is in its lower position, the various clamping devices which comprise the holding mechanism 26 are in open position, and the various folding plates which comprise the folding mechanism 24 are in first position, as shown in FIG. 3. The folding plates 30, 30 in first position cooperate with the belt sets 120 and 122 to define a matrix. The infeed conveyor 14, which may operate continuously, and in timed relation with the other mechanisms which comprise the machine 10, carries an article A to be wrapped toward the elevating mechanism 18 and deposits it on the horizontal article supporting surface defined by the support members 108, 108. At the same time, the wrapper feeding mechanism 22 advances a wrapper W, formed during the preceding machine cycle, to and positions it at the wrapping station 20. When the wrapper W is properly positioned, the leading edge of the wrapper W engages a sensing device, indicated generally at 162 in FIG. 2, which may comprise a microswitch. The latter sensing device provides a signal necessary to maintain the machine in operation. The absence of a signal from the sensing device 162 indicates a wrapper W has not been properly positioned at the wrapping station 20, as in the case of a material runout, and interrupts the machine cycle. When the wrapper W is positioned at the wrapping station 20 by the feeding mechanism 22, the material feeding cycle is completed and a clutch associated with the intermittently operated wrapper feeding mechanism disengages halting the advance of the wrapping material. When the wrapping material has stopped advancing the solenoid which operates the perforating mechanism 140 is energized whereby a line of weakening or perforation 160 is formed on the wrapping material F to define an end of a wrapper W.

The various fluid motors associated with the clamping mechanism 26 operate to move the clamping members 146, 146 into clamping relation with the lower surfaces of the folding plates 30, 30 and the clamping members 152, 152 into clamping relation with the clamping members 154, 154 whereby marginal portions of the wrapper W are clamped against the lower surfaces of the side folding plates 30, 30 and between the upper and lower belts 124 and 126 which comprise the belt sets 120 and 122. While the wrapper W is held in clamped position at the wrapping station 20, the elevating mechanism 18 operates to push the article A upwardly into stretching engagement with the wrapper W and to the position shown in FIGS. 8 and 13. It will be noted that in moving to the latter position the article A moves upwardly through the matrix formed by the inner edges of the plates 30, 30 in first position and the inner edges of the belts sets 120 and 122. The wrapper W may be separated from the next successive wrapper along the line of perforation 160 during the stretching portion of the cycle.

Figure 15:
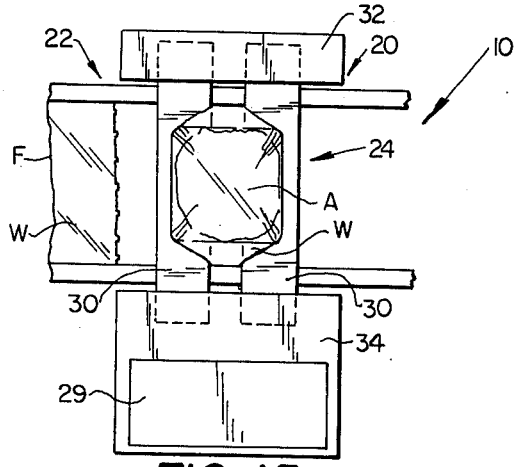

The elevating mechanism 18 dwells in its raised position and supports the article A with its lower surface immediately above the upper surfaces of the folding plates 30, 30 while the side folding plates 30, 30 move from first position (FIG. 14) to second position (FIG. 15). The clamping members 146, 146 continue to hold the wrapper against the lower surfaces of the folding plates 30, 30 at least during the initial movement of the folding plates from first to second position. As the folding plates 30, 30 move to second position the inner edges of the folding plates engage the upwardly biased support members 108, 108 pivot these support members inwardly to the positions shown in FIG. 10 wherein the folding plates 30, 30 are disposed above the downwardly retracted support members 108, 108. During movement of the folding plates 30, 30 to second position the wrapper W will be torn away from the next successive wrapper W if it has not previously been torn away during the elevating or wrapper stretching portion of the machine cycle. The folding plates 30, 30 tuck opposite marginal portions of the wrapper inwardly and against the lower surface of the article.

Figure 11:
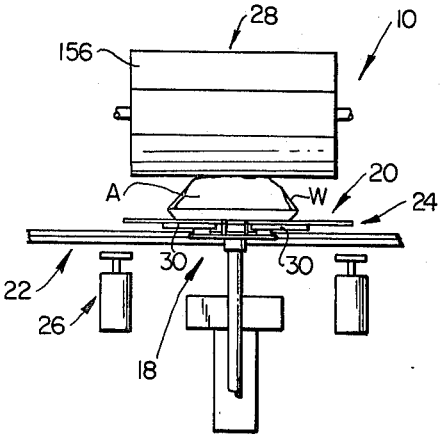

The side folding plates 30, 30 dwell in second position while the end folding plate 32 is moved from its first to its second position by the mechanism 86 whereby the marginal portion of the wrapper W disposed between the belts of the belt set 120, and held by an associated set of clamping members 152 and 154, is pulled from between the belts and tucked inwardly against the lower surface of the article A by the action of the folding plate 32, and to the position shown in FIGS. 11 and 16.

The overhead conveyor 28 operates to move the partially wrapped article A toward the heat sealing unit. As the article A is moved by the overhead conveyor the remaining portion of the wrapper W disposed between the belts of the belt set 122, and held by an associated set of clamping members 152 and 154, engages the inner edge of the stationary folding plate 34 and is pulled from between the belts and tucked under the article as the partially wrapped article moved relative to the plate 34. The partially wrapped article is then moved onto the heat sealing unit 29 where the tucked under portion of the wrapper are heat sealed into engagement with other associated portions of the wrapper to complete the package. The wrapped article may remain on the heat sealing unit, until it is moved off of the unit by line pressure exerted by the next package advanced during the next successive machine cycle.

We claim:

1. A machine for wrapping articles in stretchable wrapping material comprising folding mechanism including a pair of transversely extending first folding members, means for moving said folding members relative to each other between first and second positions, wrapper feeding means for positioning a stretchable wrapper in juxtaposition to said folding mechanism including transversely spaced longitudinally extending conveyor belts for engaging the wrapper along longitudinally extending opposite marginal portions thereof, holding means for releasably securing in fixed position opposing portions of the wrapper positioned by said feeding means, article moving means for receiving an article to be wrapped in one position and for moving the article toward the folding members and into stretching engagement with the wrapping material secured by said holding means and to another position beyond said folding members, and means defining a generally rectangular opening through which the article is constrained to pass when the article is moved from its one to its other position by said article moving means, said opening defining means comprising said feeding means and said first folding members in said first position, said conveyor belts defining longitudinally extending sides of said rectangular opening and said first folding members defining transversely extending sides of said rectangular opening, said holding means comprising means for releasably securing the longitudinally extending marginal portions of the wrapper to said conveyor belts and transversely extending portions of the wrapper to said first folding members.

2. A wrapping machine as set forth in claim 1 wherein said folding mechanism has a pair of second folding members which include a stationary folding member and a movable folding member supported for horizontal movement generally toward and away from said stationary folding member between said first and second positions.

3. A wrapping machine as set forth in claim 2 wherein said folding mechanism includes means for moving a partially wrapped article relative to said stationary folding member to complete the folding operation.

4. A wrapping machine as set forth in claim 3 wherein said means for moving a partially wrapped article comprises a conveyor above said folding members for engaging an article supported by said article moving means and moving it from said article moving means onto said stationary folding member.

5. A wrapping machine as set forth in claim 1 wherein said holding means comprises clamping means for releasably securing each of the transversely extending portions of the wrapper to an associated one of said folding members.

6. A wrapping machine as set forth in claim 5 wherein said folding members comprise a pair of opposing folding plates and said clamping means comprise a pair of clamping members and means for moving each of said clamping members into clamping relation with an associated one of said plates.

7. A wrapping machine as set forth in claim 1 including adjusting means for varying the size of said opening formed by said opening defining means.

8. A wrapping machine as set forth in claim 7 wherein said means for moving said folding members comprises said adjusting means.

9. A wrapping mechanism as set forth in claim 8 wherein said folding members comprise a pair of opposing folding plates supported for movement generally toward and away from each other between said first and second positions, said means for moving said folding members comprise a pair of actuating mechanisms, each of said actuating mechanisms being operably connected to an associated one of said folding plates, and said adjusting means comprises means for moving said actuating mechanisms relative to each other.

10. A wrapping machine as set forth in claim 1 wherein said said conveyor belts comprise two parallel pairs of endless belts.

11. A wrapping machine as set forth in claim 13 wherein each pair of belts includes an elongated upper belt and an elongated lower belt having a longitudinally extending portion thereof running in closely adjacent relation to an associated longitudinally extending portion of said upper belt.

12. A wrapping machine as set forth in claim 1 wherein said conveyor belts include a first pair of elongated endless belts having longitudinally extending portions disposed in adjacent relation for receiving one longitudinally extending marginal portion of the wrapper therebetween and a second pair of elongated endless belts parallel to said first pair and having longitudinally extending portions in adjacent relation for receiving an opposite longitudinally extending marginal portion of the wrapper therebetween and said holding means comprises means for clamping the one marginal portion of the wrapper between said first pair of belts and for clamping the opposite marginal portion of the wrapper between said second pair of belts.

* * * * *

UNITED STATES PATENT AND TRADEMARK OFFICE

CERTIFICATE OF CORRECTION

PATENT NO. : 4,178,740

DATED : December 18, 1979

INVENTOR(S) : James S. Groom and Clarence F. Prince

It is certified that error appears in the above-identified patent and that said Letters Patent are hereby corrected as shown below:

Column 10, line 58, "13" should be --10--.

Signed and Sealed this

*Twenty-ninth* Day of *April 1980*

[SEAL]

*Attest:*

SIDNEY A. DIAMOND

*Attesting Officer*

*Commissioner of Patents and Trademarks*